United States Patent [19]

Heinrich

[11] 4,176,793

[45] Dec. 4, 1979

[54] ELECTRIC CLUTCH CONTROL

[75] Inventor: Elmer G. Heinrich, Siloam Springs, Ark.

[73] Assignee: Citation Manufacturing Co., Inc., Siloam Springs, Ark.

[21] Appl. No.: 883,306

[22] Filed: Mar. 3, 1978

[51] Int. Cl.[2] ..... B05B 7/04

[52] U.S. Cl. ..... 239/407; 222/144.5; 222/333; 239/526

[58] Field of Search ..... 239/1, 10, 124, 303, 239/304, 310, 407, 412, 526; 222/63, 144.5, 333

[56] References Cited

U.S. PATENT DOCUMENTS

| | | | |
|---|---|---|---|
| 1,871,291 | 8/1932 | Adams et al. | 222/333 |
| 2,319,459 | 5/1943 | Johnson | 239/526 X |
| 3,118,610 | 1/1964 | Techler | 239/526 X |
| 3,318,535 | 5/1967 | New | 239/310 |
| 3,341,081 | 9/1967 | King | 222/333 X |

OTHER PUBLICATIONS

Stuttner Technik Spritzpistole ST 700; Data Sheet; Sep. 1977.

*Primary Examiner*—Robert B. Reeves
*Assistant Examiner*—Andres Kashnikow
*Attorney, Agent, or Firm*—Hill, Van Santen, Steadman, Chiara & Simpson

[57] ABSTRACT

An electrical control mechanism for use with high-pressure pump systems having the electrical control components housed within a pistol-like structure connected by flexible hosing to the high-pressure distribution system for convenience of directing of the high-pressure spray and also for ease of controlling the pumping system. The high-pressure distribution system being controlled by the electrical mechanisms in the pistol-like device by means of a remotely actuated electrical clutch and a remotely actuated electrical valve.

2 Claims, 4 Drawing Figures

Fig. 2
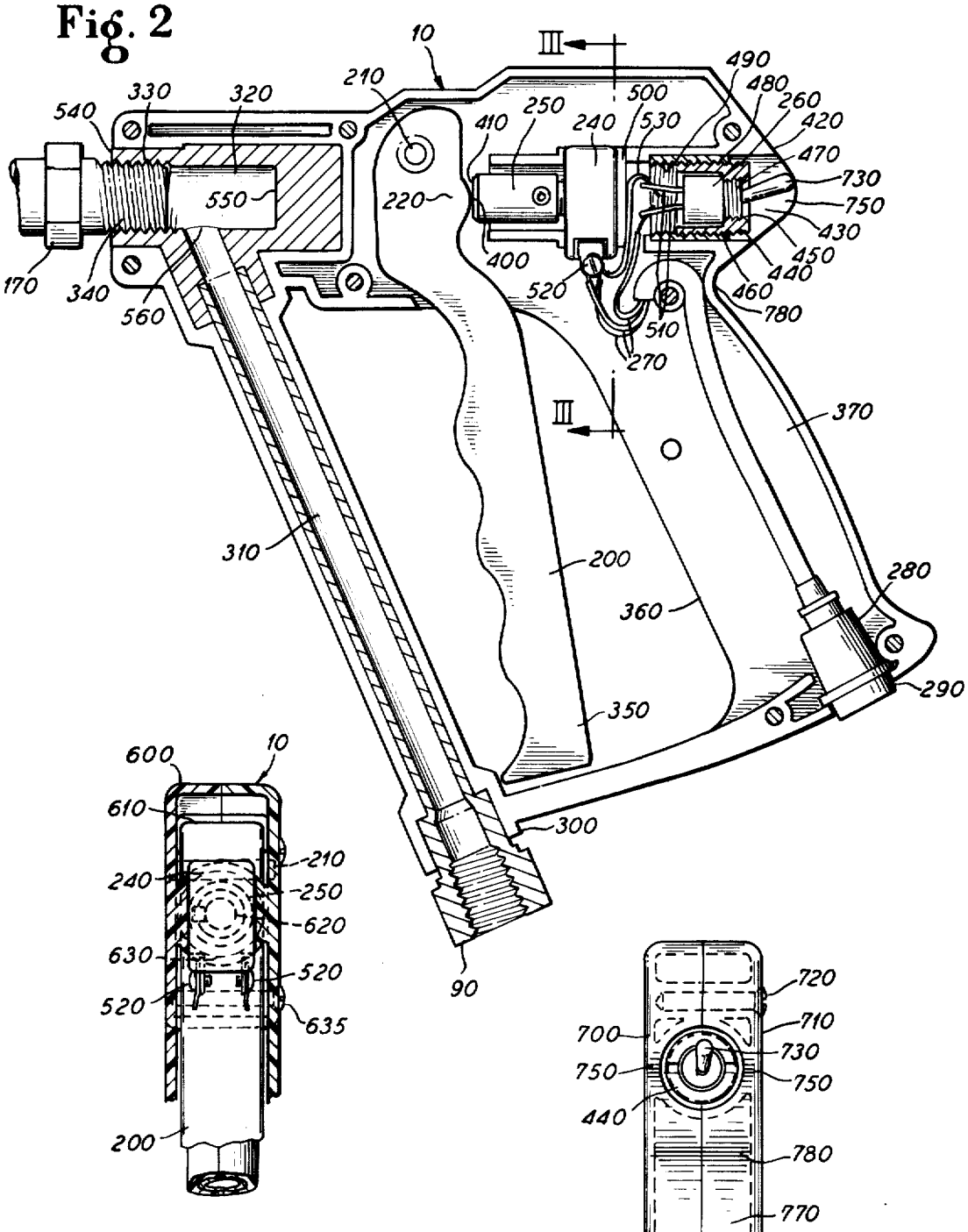
Fig. 3
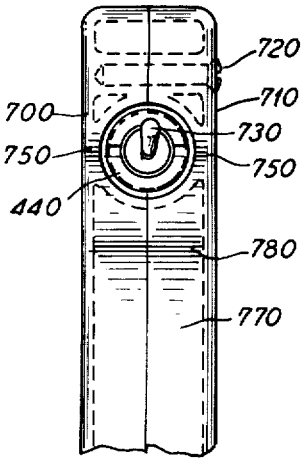
Fig. 4

ELECTRIC CLUTCH CONTROL

BACKGROUND OF THE INVENTION

1. Field of the Invention

This invention relates to control devices for use with high-pressure steam cleaning or water cleaning systems. In particular, it relates to an electrical control mechanism for controlling the pumps and mixing valves required in such systems.

2. The Prior Art

It has been common in the prior art in high-pressure pumping systems which develop pressures of 1,000 to 2,000 lbs. per square inch under normal operation with the control valves open, to use trigger valves of the type represented by a German manufactured device known as a Spritzpistole ST 700, a commercially available trigger shut off gun manufactured by Suttner Technik and marketed under the name Suttner pistol in the United States by an importer known as Kurt Wilms. The configurations of the systems which use the Spritzpistole ST 700 basically involve a high-pressure pump associated with a tank containing steam or hot water or some appropriate solvent with or without some sort of mixing apparatus which includes some sort of a soap or other cleaning agent. The liquid, detergent mixture is pumped out of the tank by the high-pressure pumps through flexible hoses and into the base of the Spritzpistole ST 700. Valving is accomplished by a needle valve conventionally manipulated on and off using a trigger having a lock mechanism with a spring-loaded adjustment. When the valve in the Spritzpistole ST 700 is closed, a pressure surge is immediately experienced by the flexible hosing connecting the pistol to the high-pressure pumping mechanism. This impulse surge can far exceed the normal 1,000 to 2,000 lbs. per square inch pressure exerted by the pumps and is a continual source of wear and tear on the hoses and plumbing. In the prior art, this problem was attempted to be alleviated by using what is known as a by-pass unloader valve in the pumping system. This unloader valve detects the impulse which is present in the flexible hose and which has traveled back to the pump from the Spritzpistole ST 700. Upon detection of this high-pressure impulse, the by-pass unloader valve trips and permits a flow of fluid around the pump thereby substantially minimizing or eliminating this high-pressure impulse. That prior art solution to the high-pressure impulse problem suffers from two chronic and recognized defects. One chronic defect is the fact that a momentary high-pressure impulse is still applied to the structure of the Spritzpistole ST 700 as well as to the flexible hoses connecting the pistol to the pumping apparatus. The duration of this impulse corresponds to the time involved until the by-pass unloader valve kicks in. A second problem has been due to the structure and nature of the by-pass unloader valves themselves. These valves are always a continual source of maintenance and reliability problems and require additional expense in terms of extra plumbing and the price of the valve itself. If should be noted also that even with the by-pass unloader valve solution to the problem, there is always a pressure applied to the flexible hosing even if the Spritzpistole ST 700 is turned off. This, in itself, represents to a certain extent a reliability problem in case one of the hoses should suddenly rupture, even if the by-pass unloader valve has functioned properly, there will still be a stream of fluid emanating from the rupture in the hose.

SUMMARY OF THE INVENTION

In accordance with the present invention a pair of electrical switches are incorporated into a modified housing of a Spritzpistole ST 700. One of the electrical switches is the control unit for an electrical clutch coupled to the high-pressure pump system. The second electrical switch consists of the control for a mixing valve which permits or disables the mixing of additional cleaning materials, such as soaps or other such solutions with the basic cleaning solvent such as hot water or steam. By virtue of such provision the pressure surges can be eliminated. The operation of the control system disables the high-pressure pump immediately and cuts off the presence of any pressure whatsoever within the flexible tubing and within the control pistol itself. Thus, applicant's invention results in a system having longer hose life, being a safer device, in that without pressure being present in the hoses and the pistol, if for some reason a hose should rupture or the pistol should be left in the on position, an unlikely but possible occurrence, there will be no pressure to drive the fluids out of the rupture or to drive the piston across the floor, potentially causing damage to property and injury to personnel.

BRIEF DESCRIPTION OF THE FIGURE

FIG. 2 is a view of the control pistol with cover removed showing additional details of the present invention.

FIG. 3 is a cross section taken on the line III—III of FIG. 2 showing the structural detail of the switch control of the clutch.

FIG. 4 is a rear view showing the rear detail of pistol and the mixing valve switch.

DESCRIPTION OF THE PREFERRED EMBODIMENT

Figure 1:
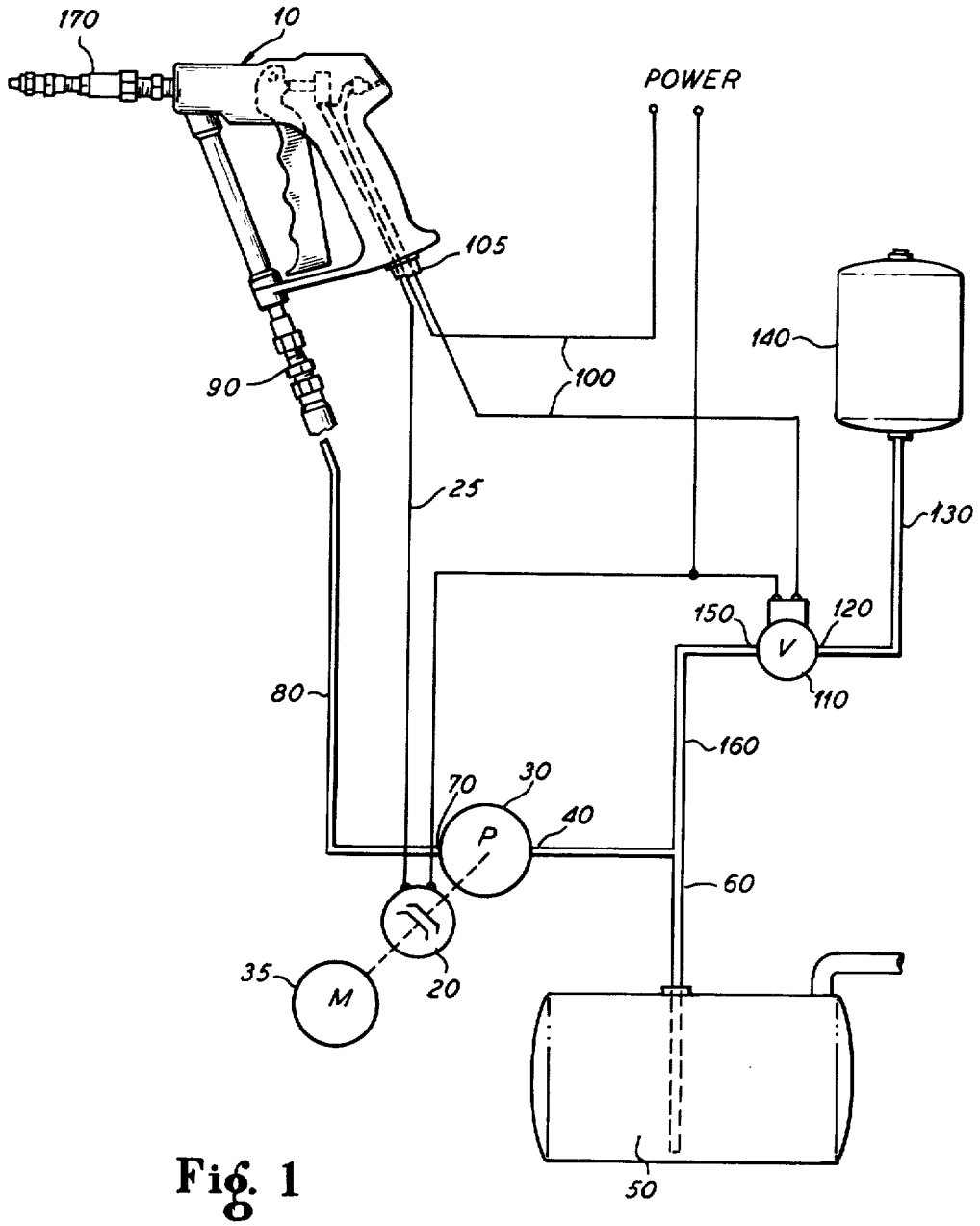
FIG. 1 is a schematic view showing a complete system with the improved electrical control system for the pump and the mixing valve.

While the principles of the present invention have a particular utility in a control device for use with high pressure clamping and spraying systems, it will be understood that the control device of the present invention may be utilized in other combinations. By way of exemplary disclosure of the best mode of practicing the invention, there is shown generally in FIG. 1, a block diagram of a high pressure pump and cleaning system utilizing applicant's improved control device. Generally, FIG. 1 discloses a control pistol 10 connected to a clutch 20 by a wire 25. The clutch 20 is mechanically affixed to a high pressure pump 30 driven by a motor 35 through the clutch 20. The pump 30 has an input port 40 connected to a source of solvent 50 which might be fluid or steam by piping 60. The pump 30 also has an output port 70 for the high pressure cleaning fluid or spray, which is connected to a flexible hose 80 which in turn is connected to the control pistol 10 by a conventional coupling 90. The control pistol 10 is also connected electrically by wires 100 to a control valve 110, which has an input port 120 which is connected to a piping distribution system 130 which provides a source of addition solvent in a tank 140. The valve 110, which serves as a mixing valve is connected by its output port 150 through a piping distribution system 160 to the piping system 60 which in turn permits a blended solution consisting of the fluid in the tank 140 and the solvent in the tank 50 to appear at the input port 40 of the pump 30. The control pistol 10 has an output nozzle of conventional variety 170 for use in directing the mixed output spray to an appropriate area to be cleaned. The pistol is connected to the wires 25 and 100 by an external connector 105.

Again, with respect to FIG. 1, it is important to note, that the control device which is the modified Spritzpistole ST 700 has the advantage of being a device of conventional shape and form well known in the prior art, at least for its external functioning appearance, and having the further advantage that it may be readily coupled using the conventional coupling 90 into existing, compatible, high pressure cleaning systems.

FIG. 2 illustrates the modified control pistol 10 with the cover removed. The modified control pistol 10 has a control bar 200, having a pivot point 210, with an actuating cam surface 220 operatively arranged with respect to a switch 240 having a spring loaded plunger 250. The switch 240 is the control for engaging the clutch 20 whereby the pump 30 can be driven by the motor 35. The pistol 10 includes an on-off toggle switch 260. Both switches 240 and 260 are electrically connected by wires 270 to a plug 280 at the base 290 of the pistol 10. The switch 260 is the control for the mixing valve 110. The distribution system within the pistol 10 includes the conventional coupling 90 affixed to the front base 300 of the pistol 10, wherein there is a passageway 310 coupled to a chamber 320 having a threaded end 330 into which the conventional nozzle 170 having external threads 340 is screwed. An appropriate cable consisting of connector 105 and wires 25, 100 connects the switches 240 and 260 by plug 280 to the clutch 20 and valve 110 respectively.

Operationally, with respect to FIG. 2, as the control bar 200 is pivoted around the pivot point 210 and caused to rotate at its lower extremity 350 toward the front end 360 of the handle 370 of the pistol 10, a surface 400 on the cam 220 ceases to interlock with a surface 410 on the front of a plunger 250 of the switch 240, thereby allowing the spring actuated switch 240 to close completing an electrical circuit through the connecting cable 270 and the electrical connection 280 at the base 290 of the pistol 10. As can be seen from FIG. 2, when the control bar 200 is released, the spring loaded switch 240 acts by means of the plunger 250 and the surface 410 against the surface 400 of the cam 220 to drive the control bar forward, thus releasing the plunger 250 of the switch 240 and allowing it to open the electrical circuit through the wiring 270 and 25. Hence, the clutch 20 which had been activated by closing the switch 240 becomes deactivated, thereby disabling the pump 30 and eliminating the high pressure in the flexible hoses 80 through the coupling 90 through the pistol 10 and out through the nozzle 170. As can immediately be recognized, because the clutch 20 is controlling the pumping by the pump 30, there will be no high-pressure impulses generated anywhere throughout the distribution system.

Again with respect to FIG. 2, the toggle switch 260, being electrically connected through the cable 270 and the plug 280 to the electrically controlled mixing valve 110 can close the circuit through the wires 270, the plug 280 and the external wiring 100 so that electrical valve 110 is opened and closed by the action of the toggle switch 260 located in the pistol 10.

The toggle switch 260 is located at the rear 420 of the pistol 10 in a depression 430 which contains a nut 440 having internal threads 450 and external threads 460. The toggle switch 260 is screwed into the nut 440 by conventional threads 470 on the toggle switch 260 which mate with the threads 450 internal to the nut 440. The nut 440, in turn, by means of the threads 460, mates with the threads 480 of an interior fitting 490 seated in the depression 430 of the pistol 10. The nut 440 which has both the internal threads 450 and the external threads 460 corresponds to the nut conventionally provided at the rear of the Spritzpistole ST 700 but modified with additional threading so as to receive the toggle switch 260. The usual spring loading mechanisms of the Spritzpistole ST 700 are not utilized in its present invention and are eliminated. There is a separating bar 500 between the switch 240 and a set of electrical contacts 510 associated with the contacts of the switch 260 onto which the wires 270 are attached. The spring-actuated switch 240 has a set of electrical contacts 520 which also serve as the connecting points for the wires 270. A common power lead 530 connects the switch 240 and the switch 260 through one of the pair of electrical contacts 520 and one of the pair of electrical contacts 510 respectively.

The chamber 320 at the front of the pistol 10, as noted previously, has one threaded end 540 having threads 330 and a sealed end 550. The transmission path 310 through which the cleaning solvent passes enters the chamber 320 by a port 560 at the base of the chamber 320.

There is no high pressure present in the hoses 80 and in the pathway 310 of the pistol 10 when the control bar 200 is released to disable the clutch 20 and turn off the pump 30.

The detail structure of the switch 240 within the pistol 10 is shown in FIG. 3 wherein a slice of the housing 600 of the pistol 10, and an end view of the top portion 610 of the control bar 200 is illustrated with the pivot point 210 indicated, the switch 240 looking from the rear thereof, showing the plunger 250 with a neck 620 affixing the plunger 250 to the switch housing 240 with a flange 630 being affixed to the pistol 10. Also indicated are the electrical connections 520 to the switch 240 and the control bar 200. A connecting screw 635 of the pistol 10 is also shown.

FIG. 4, a rear view of the pistol of FIG. 2, illustrates the two sides 700 and 710 of the exterior housing 600 of the pistol 10. As indicated by FIG. 4, a screw 720 is effective to hold together the two sides 700 and 710. The toggle switch 260 has a handle 730 which is used for altering the state of the switch 260 thereby to control the electrical valve 110. The nut 440 is indicated holding the switch 260 within the depression 430 between the ears 750 so as to keep the handle 730 of the switch 260 from being inadvertently jiggled on and off while the pistol 10 is in use. The rear 770 of the handle 370 is indicated as well as the comfort depression 780 which makes the pistol convenient to hold.

Although various modifications might be suggested by those skilled in the art, it should be understood I wish to embody within the scope of the patent warranted hereon all such modifications as reasonably and properly come within the scope of my contribution to the art.

I claim as my invention:

1. An improved, high pressure cleaning system having a first and a second source of solvent, a high pressure pump with an input port connected to the first source of solvent, and mechanically connected to an electric drive motor; a hand-held spray gun, the spray gun having a housing with a handle and a barrel, the barrel having an output spray nozzle at one end thereof, the handle being located at a selected angle with respect to the barrel and having a hollow trigger guard located in front of the handle with a coupling connected to the bottom of the trigger guard to which a high pressure hose could be attached; a path including the passage in the hollow trigger guard of the pistol connecting the high pressure hose coupling and the output nozzle; an elongated control bar with a first and a second end, pivotally mounted at the first end in the housing of the gun and extending between the handle and the trigger guard and terminating at the second end and having a first surface oriented toward the handle;

the improvement comprising:

an electrically controlled clutch, located between the electric motor and the pump, operable to disconnect the motor from the pump upon receipt of an electrical control signal;

a single, electrically controlled, valve having only an input port and an output port located in a pipe connecting the second source of solvent to a pipe connecting the first source of solvent to the input port of the pump;

an improved spray gun with said control bar having a circular cam surface located on said first surface and within said housing, a low power, two terminal, clutch control switch, having a spring activated plunger, affixed within said housing with an end of said plunger being located adjacent said cam surface of said control bar, a low power, two terminal, valve control switch mounted within said housing adjacent a top section of said handle, a low power, three conductor, cable having a first and a second end with said first end being affixed to a bottom section of said handle and extending into said handle;

a first of said three conductors, at said first end, being connected to a first of said two terminals of said clutch control switch and a first of said two terminals of said valve control switch, a second of said three conductors at said first end being connected to a second of said two terminals of said clutch control switch, a third of said three conductors at said first end being connected to a second of said two terminals of said valve control switch;

said first conductor at said second end being connected to a power input terminal, said second conductor at said second end being connected to a first control input to said clutch, said third conductor at said second end being connected to a first control input to said valve;

a second control input to said clutch being connected to a second control input to said valve and to a second power input terminal;

whereby said control bar is operable to close said clutch control switch when said second end of said bar is rotated toward said handle thereby rotating said cam surface against said end of said plunger of said clutch control switch causing said plunger to move axially thereby closing said clutch control switch to energize said clutch and enabling the electric motor to drive the pump which in turn pumps solvent at high pressure through the hose to the nozzle of said improved gun, and whereby said spring biased plunger is operable to move said control bar rotatably away from said clutch control switch, if said gun is dropped, thereby immediately opening said clutch control switch and deenergizing said clutch which blocks the motor, which still continues to run, from driving the pump thereby immediately resulting in a loss of solvent pressure to said improved gun, and whereby, said valve control toggle switch is operable to open and close said valve with the result that the first solvent alone or a mixture of the first and second solvents is made available to the input port of the high pressure pump.

2. The improved cleaning system according to claim 1 wherein said improved spray gun has a compartment, isolated from the path within the gun through which the solvent passes, wherein said switches and said low power cable are located.

* * * * *